United States Patent [19]

Azami et al.

[11] Patent Number: 4,985,322

[45] Date of Patent: Jan. 15, 1991

[54] PROCESS AND APPARATUS FOR PRODUCING PRINTING PLATES

[75] Inventors: Kyoichiro Azami, Chiba; Shouji Kume, Tokyo, both of Japan

[73] Assignee: Dainippon Ink and Chemicals, Inc., Tokyo, Japan

[21] Appl. No.: 500,109

[22] Filed: Mar. 27, 1990

Related U.S. Application Data

[63] Continuation of Ser. No. 221,829, May 9, 1988, abandoned.

[30] Foreign Application Priority Data

Sep. 10, 1986 [JP] Japan ..... 61-211501

[51] Int. Cl.[5] ..... G03G 13/01

[52] U.S. Cl. ..... 430/49; 430/44

[58] Field of Search ..... 430/49, 44, 43, 47; 355/244

[56] References Cited

U.S. PATENT DOCUMENTS 4,281,051 7/1981 Sakai ..... 430/42
4,686,163 8/1987 Ng et al. ..... 430/47
4,708,459 11/1987 Cowan et al. ..... 430/30

*Primary Examiner*—John Goodrow
*Attorney, Agent, or Firm*—Armstrong, Nikaido, Marmelstein, Kubovcik & Murray

[57] ABSTRACT

The process and apparatus for producing printing plates of this invention are for optically color separating a transmitted light or reflection light from a color original (1) and producing color-separated printing plates (18) each having each different color by the color-separated light. Hitherto, each color-separated printing plate of each color is produced by photographing a color-separated light, i.e., color-separated images using a photographic film such as an expensive silver salt photographic film, etc., and printing the color-separated images thus photographed using the photographic film as an intermediate onto a printing plate such as a pre-sensitive printing plate, etc. On the other hand, in this invention, each color-separated printing plate (18) is directly produced from a color original without using a photographic film such as an expensive silver salt photographic film as an intermediate by using an organic photoconductive material having a whole light wavelength of from 400 n.m. to 700 n.m. as an original printing plate (9), using an electrophotographic process, light-exposing the charged original printing plate (9) with color-separated light formed by optically color separating a transmitted light or reflected light from a color original (1), forming toner images on the light-sensitive (photoconductive) layer of the original printing plate (9), fixing the toner images, and removing the non-image portions of the light-sensitive layer of the original printing plate (9) or rendering the non-image portion hydrophilic.

4 Claims, 11 Drawing Sheets

PROCESS AND APPARATUS FOR PRODUCING PRINTING PLATES

This application is a continuation of application Ser. No. 221,829 filed May 9, 1988 now abandoned.

FIELD OF THE INVENTION

This invention relates to a process of producing a printing plate which can directly producing a color separation printing plate by optically color separating a transmitted light or reflected light from a color original and utilizing the color separated light as it is and also the invention further relates to an apparatus for producing the aforesaid printing plate.

BACKGROUND OF THE INVENTION

A process of color separating a transmitted light or reflected light from a color original into so-called three primary colors of R (red), G (green), and B (blue) by an ordinary optical method using, for example, red, green and blue-purple color filters, making negative or positive films for blue printing (cyan), red printing (magenta), and yellow printing (yellow) basing on the lights of three colors of R, G, and B, and then making each color separated printing plate using each film thus obtained has hitherto been widely performed. In the process, photographic light-sensitive materials having light-sensitive characteristics in the whole wavelength region of visible light of from 400 n.m. to 700 n.m. are required.

Hitherto, as the light-sensitive materials having such light-sensitive characteristics, silver salt light-sensitive films are used. However, the silver salt light-sensitive films are expensive as compared to ordinary films and in the case of using such silver salt light-sensitive films, it is difficult to handle the films in bright room. In the case of using a silver salt light-sensitive material, it cannot be directly used as a printing plate but a process of developing and fixing the silver salt light-sensitive film and then printing the positive or negative images formed on the silver salt film onto an original printing plate such as a presensitized printing plate (PS printing plate), etc., to make a printing plate is required.

These sequential operations per se, are troublesome and require specific apparatuses for each operation. An expense for these apparatuses, and personnel, as well as material cost for light-sensitive films cannot be disregarded.

This invention has been achieved in view of forgoing problems to provide color separating printing plate directly from the color originals in a short time.

DISCLOSURE OF THE INVENTION

A process for producing a printing plate according to this invention comprises forming toner images on an original printing plate by an electrophotographic process using a photoconductive material as the original printing plate, fixing the toner images formed thereon, and removing the non-image portions of the light-sensitive (photoconductive) layer or rendering the non-image portions hydrophilic to produce a printing plate, which comprises using an organic photoconductive material having light-sensitive characteristics at a whole light wavelength region of from 400 n.m. to 700 n.m. as the photoconductive material and exposing the aforesaid original printing plate to color-separated light obtained by color separating a transmitted light or a reflected light from a color original, whereby a color-separated printing plate is directly obtained from the color original.

An apparatus for producing a printing plate using an organic photoconductive material according to this invention has light-sensitivity at a whole light wavelength region of from 400 n.m. to 700 n.m. and produces color-separated printing plate by an electrophotographic process, comprising a plate for placing an original, a light source, color filters, a lens system, an original printing plate setting portion, a device for electrostatically charging the original printing plate, a device for developing the original printing plate imagewise exposed, a device for fixing toner images formed by the development, a means for removing the non-image portions of the light-sensitive (photoconductive) layer or a means for rendering the non-image portions hydrophilic, and a means for transporting the original printing plate or the printing plate thus produced.

Preferred examples of the organic photoconductive material (hereinafter, is referred to as "panchromatic light-sensitive material" or "light-sensitive material") are as follows.

(1) A first preferred example is a light-sensitive material comprising an electrically conductive support (hereinafter, is referred to simply as conductive support) a light-sensitive layer composed of (a) a perylene compound, (b) a phthalocyanine compound, (c) an oxadiazole compound, and (d) an alkali-soluble resin.

(a) As the perylene compound (a), various kinds of perylene compounds which have hitherto been used for electrophotographic materials can be used without particular restrictions but the compound shown by formula:

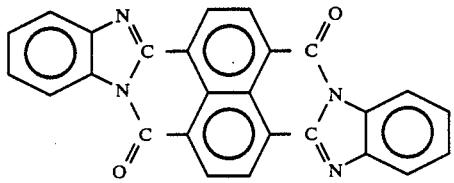

is particularly preferred.

(b) As the phthalocyanine compound, there are metal or non-metal phthalocyanine compounds and preferred examples thereof are titatium oxyphthalocyanine, vanadium oxyphthalocyanine, aluminum monochlorophthalocyanine, magnesium phthalocyanine, copper phthalocyanine, and these metal phthalocyanines at least one of the four benzene nuclei of which is substituted by a halogen atom, a nitro group, an amino group, an alkyl group which may have a substituent, an aralkyl group which may have a substituent, or an aryl group which may have a substituent. Titanyl phthalocyanine compounds are particularly preferred.

(c) As the oxadiazole compounds, there are oxadiazoles such as 2,5-bis(4-dimethylaminophenyl)-1,3,4-oxadiazole, 2,5-bis(4-aminophenyl)-1,3,4-oxadiazole, 2,5-bis(4-diethylaminophenyl)-1,3,4-oxadiazole, 2-(4'-aminostyryl)-5-phenyl1,3,4-oxadiazole, 2-(4'-cminostyryl)-5-(4''-methylphenyl)1,3,4-oxadiazole, etc.; N-alkylcarbazole compounds such as N-methylcarbazole, N-ethylcarbazole, N-propylcarbazole, etc.; and dialkylaminobenzoic acids such as dimethylaminobenzoic acid, diethylaminobenzoic acid, dipropylaminobenzoic acid, etc. In the aforesaid compounds, 2,5-bis(4-diethylaminophenyl)-1,3,4-oxadiazole is particularly preferred.

(d) Examples of the alakli-soluble resin are a styrene-maleic acid copolymer and a copolymer of a polymerizable monomer such as an acryl monomer, a vinyl acetate monomer, a styrene monomer, a vinyl chloride monomer, etc., and a carboxy containing polymerizable monomer such as acrylic acid, methacrylic acid, maleic acid, fumaric acid, itaconic acid, etc.

In the light-sensitive layer of the first preferred example, the amounts of the perylene compound (a) and the phthalocyanine compound (b) are each from 0.5 to 90% by weight, and preferably from 10 to 40% by weight based on the amount of the alkali-soluble resin (d).

The amount of the oxadiazole compound (c) is from 0.1 to 90% by weight, and preferably from 1 to 80% by weight based on the alkali-soluble resin (d).

(2) A second preferred example is a light-sensitive material comprising a conductive support having formed thereon a light-sensitive layer composed of (a) an anzanthrone compound, (b) a phthalocyanine compound, (c) an oxadiazole compound, and (d) an alkali-soluble resin.

As the anzanthrone compound (a), various kinds of anzanthrone compounds which have hitherto been used for electrophotographic materials can be used without particular restrictions but the compounds shown by the formula are particularly preferred;

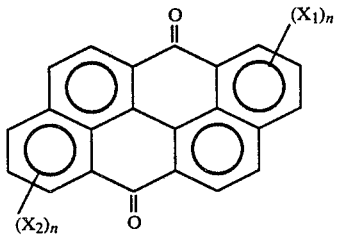

wherein $X_1$ and $X_2$ each represents a halogen atom and n represents 0 or an integer of from 1 to 4.

In the light-sensitive material of the second preferred examples, as the components (b), (c) and (d), the same components described above for the light-sensitive material of the first preferred example can be used.

The amounts of the anzanthrone compound (a) and the phthalocyanine compound (b) are each from 0.5 to 90% by weight, and preferably from 10 to 40% by weight based on the alkali-soluble resin (d). Also, the amount of the oxadiazole compound (c) is from 0.1 to 90% by weight, and preferably from 1 to 80% by weight based on the amount of the alkali-soluble resin (d).

(3) A third preferred example is a light-sensitive material comprising a conductive support having formed thereon a light-sensitive layer composed of (a) a disazo compound, (b) a perylene compound, (c) an oxadiazole compound and (d) an alkali-soluble resin.

As the disazo compound (a), the are compounds shown by formula (I);

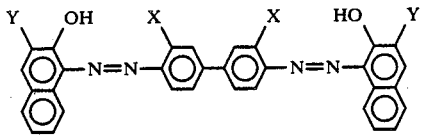

(I)

In above formula (I), Y represents a group selected from the groups shown by following formulae (II) to (IV)

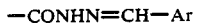

(II)

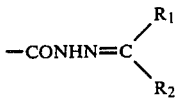

(III)

and

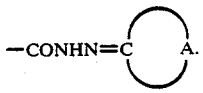

(IV)

In formula (I), X represents a group selected from H, $CH_3$, $OCH_3$, Cl, Br and $NO_2$.

Also, in formula (II) described above, Ar represents a group selected from a phenyl group, a naphthyl group, an anthryl group, a pyridyl group, a thienyl group, a furyl group, and a carbazolyl group, each group may have a substituent; in formula (III), $R_1$ and $R_2$ each represents an alkyl group or an aryl group, each may have a substituent; and in formula (IV), A⌒C=represents a hydrocarbon ring group which may have a substituent or a heterocyclic group which may have a substituent.

In formula (II) described above, the groups shown by Ar may have substituent and examples of the substituent are an alkyl group (e.g., a methyl group, an ethyl group, etc.), an alkoxy group (e.g., a methoxy group, an ethoxy group, etc.), an acyl group (e.g., an acetyl group, a benzoyl group, etc.), an alkylamino group (e.g., a dimethylamino group, a diethylamino group, etc.), an alkylester group (e.g., a methylester group, an ethylester group, etc.), a phenylester group, a phenylcarbamoyl group, a nitro group, and a cyano group.

The group shown by Ar may have one or more such substituents and when the group of Ar have plural substituents, they may be the same or different.

In formula (III), $R_1$ and $R_2$ each represents an alkyl group or an aryl group each may have substituent as illustrated above as the substituents for the groups shown by Ar in formula (II).

In formula (IV) described above, A⌒C=represents a divalent hydrocarbon ring residue such as

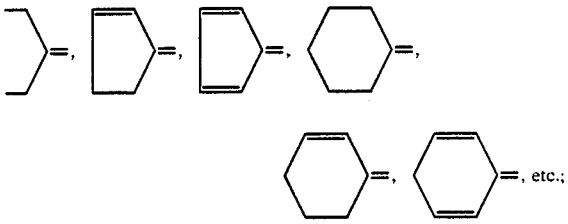

a divalent heterocyclic ring residue such as

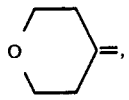

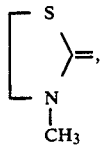

etc.; a divalent condensed hydrocarbon ring residue, $CH_3$ such as

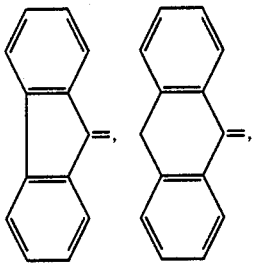

etc.; or a dovalent condensed heterocyclic residue, such as

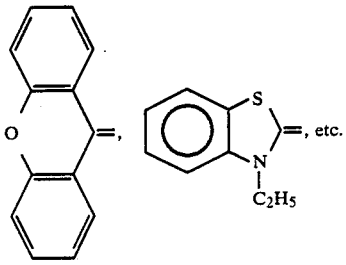

, etc.

The groups shown by A⌒C=described above may have substituent as illustrated above as the substituents for the groups shown by Ar in formula (II).

The components (b), (c), and (d) in the above-described light-sensitive material in the third preferred example are same as those of the light-sensitive material in the first preferred example.

The amounts of the disazole compound (a), the perylene compound (b), and the oxadiazole compound (c) of the light-sensitive layer are from 1 to 20% by weight for component (a), from 5 to 70% by weight for component (b), and from 1 to 70% by weight for component (c) based on the alkalisoluble resin (d).

(4) A fourth preferred example is a light-sensitive material comprising a conductive support having formed thereon (a) a zinc oxide compound, (b) a phthalocyanine compound, (c) a positive hole transporting material, and (d) a binder resin.

As the zinc oxide compound (a), the compound sensitized by dye is preferred and as the phthalocyanine compound (b), those illustrated above for the light-sensitive material in the first preferred example can be used.

As the aforesaid positive hole transporting material (c), any positive hole transporting materials which have hitherto been used for electrophotographic materials can be used without restriction.

As proper positive hole transporting materials, there are oxadiazole compounds such as 2,5-bis(4-dimethylaminophenyl)-1,3,4-oxadiazole, 2,5-bis(4-diethylaminophenyl)1,3,4-oxadiazole, 2,5-bis(4-aminophenyl)-1,3,4-oxadiazole, 2-(4'-aminostyryl)-5-phenyl-1,3,4-oxadiazole, 2-(4'-aminostyryl)-5-(4''-methylphenyl)- etc.; N-alkylcarbazole compounds such as N-methylcarbazole, N-ethylcarbazole, N-propylcarbazole, etc.; dialkylbenzoic acid compounds such as dimethylaminobenzoic acid, diethylaminobenzoic acid, dipropylaminobenzoic acid, etc.; and indole compounds such as 2-methylindole, 3-methylindole, 2-ethylindole, 2-phenylindole, 3-indoleacetone, indoxole, etc. In the aforesaid compounds, oxadiazole compounds and N-alkylcarbazole compounds are preferred and among them, 2,5-bis(4-diethylaminophenyl)-1,3,4-oxadiazole and N-ethylcarbazole are particularly preferred.

As the binder resim (d), conventional binder resins which have hitherto been used for electrophotographic materials without any restrictions but polystyrene, polyacrylamide, poly-N-vinylcarbazole, a polyamide resin, a polyester resin, an epoxy resin, a phenoxy resin, a polycarbonate resin, and also the alkali-soluble resins illustrated above for the light-sensitive material in the first preferred example can be suitably used.

The mixing proportions of the zinc oxide compound (a), the phthalocyaninde compound (b), the positive hole transporting material (c), and the binder resin (d) in the light-sensitive layer are from 0.1 to 30% by weight for component (b), from 0.1 to 30% by weight for component (c), and from 10 to 100% by weight for component (d) based on the amount of component (a).

In the aforesaid light-sensitive materials of the first to fourth preferred examples, the thickness of each light-sensitive layer is from 3 to 50 μm, and preferably from 3 to 15 μm.

As the conductive support for the light-sensitive material described above, an aluminum plate subjected to blasting, which has hitherto been widely used as base plate for printing plate, a resin-impregnated paper subjected to an electric conductive treatment, a metal plate such as zinc plate, copper plate, etc., and a plastic sheet having a vapor deposited metal layer can be used.

Each of the light-sensitive materials of the aforesaid preferred examples from the first example to the fourth example is prepared by dissolving a binder resin in a proper organic solvent or an aqueous alkali solution, adding aforesaid components (a) to (c) to the solution, uniformly dispersing the mixture by means of a dispersion device such as ball mill, paint shaker, red devil, ultrasonic dispersing means, etc., and coating the dispersion on a conductive support followed by drying.

A process of forming inking portions and non-inking portion employed at making a printing plate using a light-sensitive material is classified into the following two processes.

A first process is a so-called decoating process. According to this process, toner images are formed on a light-sensitive material using an electrophotographic apparatus and after fixing the toner images, the surface of the light-sensitive material is developed by an aqueous alkali solution containing an alkali such as sodium hydroxide, sodium silicate, etc., whereby the non-image portions are dissolved off and the toner images only are left without removing. At printing, the toner image portions left on the plate become the inking portions and the exposed surface portions of the support become the non-inking portions. The printing plate thus prepared is used as a lithographic printing plate using damping water.

The first process is applied to the light-sensitive materials of the aforesaid first to third preferred examples. The first process is also applied to the light-sensitive material of the fourth preferred example when an alkalisoluble rein is used as the binder resin for the light-sensitive material.

A second process is a so-called non-decoating process.

In the second process, toner images are formed on a light-sensitive material using an electrophotographic apparatus and after fixing the toner images, the non-image portions of the surface of the light-sensitive material are subjected to a hydrophilized treatment. As well known, when the light-sensitive layer contains zinc oxide, the non-image portions are rendered hydrophilic by treating with a processing solution containing potassium ferrocyanide. Also, by coating the surface of a light-sensitive material having fixed toner images with a hydrophilic resin solution containing a repelling agent, the solution is selectively applied to the non-image portions only by utilizing the repelling phenomenon to render the non-image portions hydrophilic. The second process is applied to the light-sensitive material of the fourth example using a resin insoluble in aqueous alkali solution as the binder resin.

The panchromatic light-sensitive materials which can be used in this invention are illustrated above but the light-sensitive materials for use in this invention are not limited to the light-sensitive materials of the aforesaid first to fourth preferred examples but any light-sensitive materials having panchromatic characteristics can be used in this invention.

According to this invention, a color-separated, printing image can be obtained from a color original without using a silver salt light-sensitive film or other film intermediate by directly forming color-separated images on an original printing plate. Accordingly, since the working steps can be reduced, the time required for producing printing plates can be greatly reduced and the cost for the production thereof can be reduced. Also, since the number of equipments for the production of printing plates can be reduced and also silver salt light-sensitive films are not used, the costs for equipments and materials are greatly reduced.

Furthermore, since original printing plates each having same performance can be used for producing any color-separated printing plates, inexpensive original printing plates can be used and also these original printing plates can be easily controlled and handled.

Also, in the printing plate producing apparatus of this invention, when in the case of supplying sheet-form original printing plates one by one from an original printing plate supplying means, one side of the outer surface of the outermost original printing plate in laminated state is adsorbed by adsorbers such as adsorption rubbers, etc., and the adsorbers are raised, the end portion of the outermost original printing plate can be separated other original printing plate desposed thereunder and then when an insertion member such as a supporting bar, etc., is inserted in the lower portion of the raised end portion of the original printing plate and the insertion member is moved to the other end portion of the original printing plate, the other end portion of the uppermost original printing plate can be separated from the under printing plate, whereby the uppermost original printing plate can be completely separated from the under original printing plate. Thus, at the supply of original printing plates, the uppermost original printing plate can be supplied without being rubbed with the lower original printing plate and without injuring the light-sensitive layer of the original printing plate.

Furthermore, in the printing plate producing apparatus of this invention, when at light exposure of a printing plate, a suction head pulling an original printing plate and a screen in close contact with the original printing plate are separated from each other in a direction perpendicular to the surfaces thereof, the original printing plate and the screen are separated while keeping the interval of both the members at constant interval in every portion thereof, whereby latent images formed by light-exposure can be prevented from being disturbed without concentrating electrostatic charges at specific portions and, thus, without causing sparking phenomenon.

BRIEF EXPLANATION OF DRAWINGS

Figures show examples

BEST MODE FOR CARRYING OUT THE INVENTION

Then, examples of the process and apparatus for producing printing plate in this invention are explained by referring to the accompanying drawings.

First Example

Figure 1:
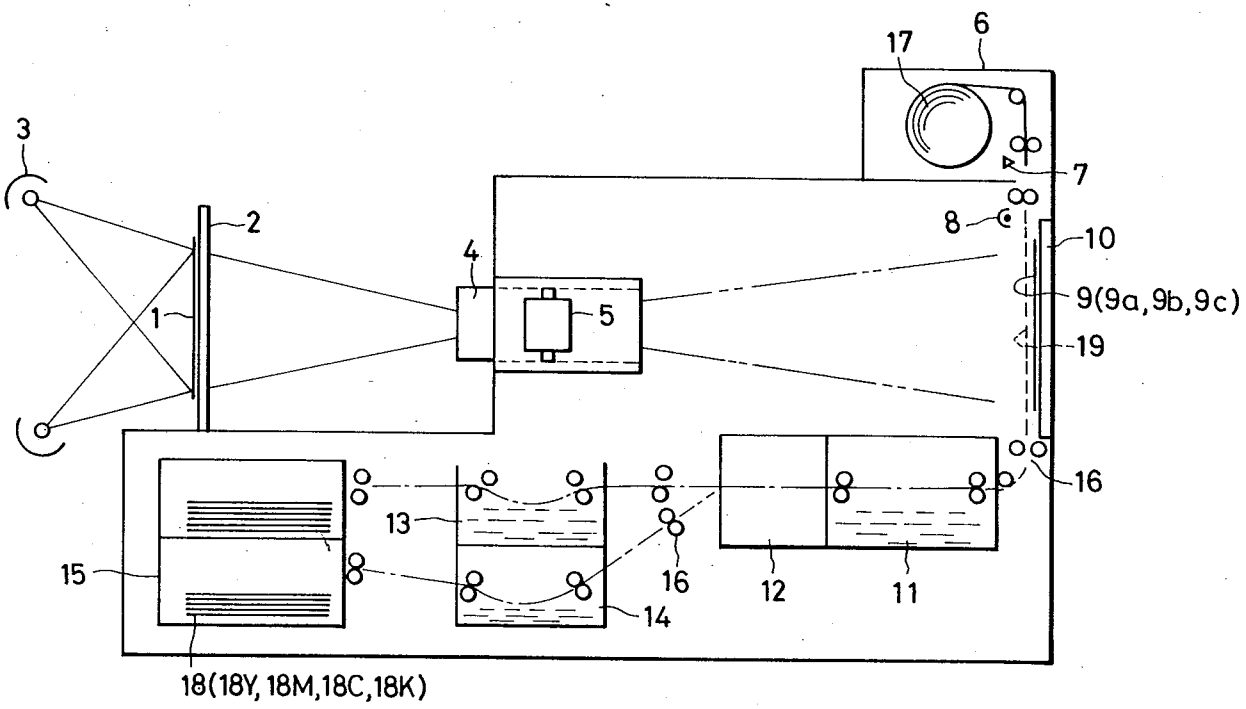
FIG. 1 is a schematic view showing a first example of the printing plate producing apparatus of this invention.

FIG. 1 is a schematic view showing a first example of the apparatus for producing color-separated printing plates.

The apparatus of the first example shown in FIG. 1 is composed of an original placing plate 2 (equipped with a means for determining the position of an original 1) for placing an original 1, a light source 3 such as a halogen lamp, a xenon lamp, etc., three or more color filters 4 selectively used for color separating a color original, a lens system 5, an original printing plate supplying means 6, a cutter 7, an electrostatically charging means 8 such as a corona discharging means, etc., an original printing plate settling member 10 for settling an original printing plate 9 to a light-exposition position, a toner developing means 11, a fixing means 12, a means 13 for removing the light-sensitive layer at non-image portions, a means 14 for applying a hydrophilic treatment onto the non-image portions, a printing plate receiving means 15, a transporting means 16, an electric or photoelectric detection means (not shown) necessary for supplying a definite length of an ordinary printing plate 17 in a roll form to a definite position, a suction setting means by pin system and vacuum (not shown) for correctly setting a sheet-form original printing plate 9 to the original printing setting means 10 at the light-exposure position, and a control panel (not shown) for controlling the exposure amount of the light source 3, the development time of the developing means 11, the heating temperature, pressure, and time of the fixing means 12. In addition, the light-sensitive layer removing means 13 and the hydrophilic treatment applying means 14 alternatively used according to requirement. Also, the developing means 11 and the fixing means 12 are shielded by employing enclosures to prevent the toner and solvent for the developer from entering the light exposure portion and the lens system 5.

In addition, the disposition of the original placing plate 2 and the light source 3 shown in FIG. 1 is for a transparent original and the positions thereof are reversed when a reflection original is used.

Now, in the apparatus of the first example shown in FIG. 1, the original printing plate 17 in roll form is fed to the original printing plate settling portion 10 through the cutter 7 and the charging means 8, wherein the sheet-form original printing plate 9 cut into a definite length by the cutter 7 and electrostatically charged by the charging means 8 is settled to the original printing plate setting portion at a definite position. The original printing plate 9 is irradiated by a transmitted light or reflected light from the original 1 on the original printing plate placing table 2 illuminated by the light source 3 through the color filter 4 and the lens system 5 to expose the original printing plate 9 to a color-separated light color-separated by the color filer 4. The original printing plate 9 having electrostatic latent images of color-separated images formed by the light exposure is transported to the toner developing means 11 and the fixing means 12 to form toner images by attaching toner to the latent images and fix the toner images. The original printing plate is further transported to the light-sensitive layer removing means 13 or the hydrophilic treatment applying means 14, wherein the removal of the light-sensitive layer at the non-image portions or the application of hydrophilic treatment to the non-image portions is carried out and the color-separated printing plate thus obtained is transported to the printing plate receiving means 15.

In addition, in the first example, in placing of the original printing plate in roll state, sheet-form original printing plates 9 may be used from the first and each of the original printing plates 9 may be supplied to the original printing plate setting portion 10 by an original printing plate supplying means (not shown) or sheet-form original printing plates 9 may be also used and each of the original printing plates 9 may be mounted manually onto the original printing plate setting portion 10. In this case, it is preferred to equip a door to the original printing plate setting portion 10 for facilitating the operation.

(Printing Plate Producing Example 1)

A mixture of 120 parts of a perylene compound, 10 parts of titanyl phthalocyanine, 150 parts of an oxadiazole compound, 660 parts of a carboxylated vinyl acetate resin (RESYN 28-2930, trade name, made by National Starch and Chemical Corp., Molecular weight 20,000), which was an alkali-soluble resin, as a binder resin, and 5500 parts of a mixed solvent of methyl ethyl ketone and methylene chloride was uniformly dispersed using a paint shaker. The dispersion obtained was coated on a sand-blasted aluminum plate of 120 μm in thickness and dried to provide an original printing plate 9a having a light-sensitive layer of 3 μm in thickness.

The aforesaid original printing plate 9a was mounted to the original printing plate setting portion 10, a color original 1 was mounted on the original placing plate 2, and a contact screen 19 for forming dot images for expressing the intermediate tones of the original 1 was set on the original printing plate 9a in close contact relation.

Then, a light exposure condition was established and the original printing plate 9a was exposed to color-separated light color-separed by the filter 4. The original printing plate 9a had previously been electrostatically charged on the light-sensitive layer by the charging means 8 and latent images of the color-separated images are formed by the light-exposure. The exposed original printing plate 9a was transported into the developing means 11 by the transporting means 16, wherein the toner was attached to the latent images to form toner images. Then, the toner images were fixed by the fixing means 12 to form imaged portion capable of enduring printing. After removing the light-sensitive layer at the non-image portions by an aqueous alkali solution in the removing means 13, the color-separated printing plate 18 thus obtained was transported out to the printing plate receiving means 15. The aforesaid step was repeated per each color printing plate of yellow, red, blue and black to produce four color-separated printing plates 18Y, 18M, 18C and 18K (yellow plate, red plate, blue plate, and black plate) for making milticolor printing from the color original.

In addition, each step described above can be all performed by automatic control system.

Also, as the toner used for the aforesaid development, a liquid developer (BBR-105, trade name, made by Dainippon Ink and Chemicals, Inc.) was used and for the removal of the coated layer, a decoating liquid (#872) (aqueous alkali solution), made by Polychrome Co. in the United State was used.

(Printing Plate Producing Example 2)

A mixture of 120 parts of dibromoanzanthrone, 10 parts of titanyl phthalocyanine, 150 parts of an oxadiazole compound, 660 parts of a polyester resin (Vylon 200, trade name, made by Toyobo Co., Ltd.) as a binder resin, and 5500 parts of a mixed solvent of methyl ethyl ketone and methylene chloride was uniformly dispersed using a paint shaker. The dispersion thus obtained was coated on an anodically oxidized aluminum plate of 240 μm in thickness and dried to provide an original printing plate 9b having a light-sensitive layer of 13 μm in thickness.

Then, by following the same procedure as Production Example 1 described above, four color-separated printing plates 18Y, 18M, 18C and 18K were produced.

(Printing Plate Producing Example 3)

A mixture of 2640 parts of zinc oxide (Sazex #2000, trade name, made by Sakai Kagaku K.K.), 20 parts of titanyl phthalocyanine, 150 parts of 2,5-bis(4-diethylaminophenol)1,3,4-oxadiazole, 660 parts of a polyvinyl acetate resin (RESYN 28-2930, trade name, made by National Starch and Chemical Corp.) as a binder resin, and 5500 parts of a mixture of methyl ethyl ketone and methylene chloride was uniformly dispersed by a paint shaker to provide a light-sensitive agent.

The light-sensitive dispersion was coated on an aluminum plate of 200 μm in thickness using a wiper bar and dried to provide a printing plate 9c having a light-sensitive layer of 15 μm in thickness.

By following the same manner as Production Example 1 described above, the original printing plate 9c was toner developed and fixed and then the non-image portions of the light-sensitive layer was treated by the hydrophilic treatment applying means 14 to provide four color-separated printing plates 18Y, 18M, 18C and 18K. For the aforesaid hydrophilic treatment, a solution of potassium ferrocyanide was used.

Printing Test

Using each of three sets of the four color-separated printing plates 18Y, 18M, 18C, and 18K obtained in the aforesaid production examples, printing was performed by means of a sheet-fed offset printing machine R-202 (two color machine) made by Man Roland Co. As the results thereof, each set of the color-separated printing plates could give good color prints almost the same as the prints by printing plates produced by a conventional technique. In addition, the number of prints in the continuous run was 50,000.

2nd Example

Figure 2:
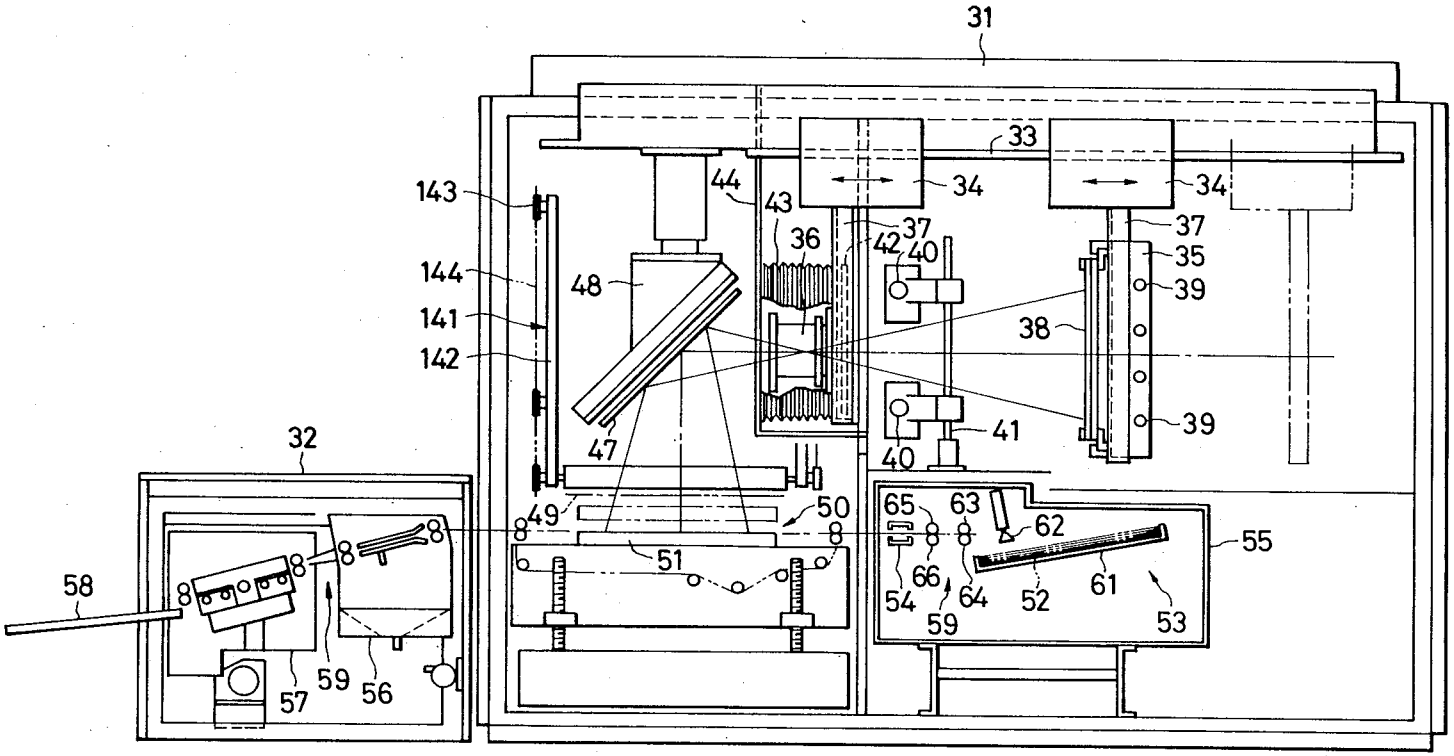
FIG. 2 is a schematic plane view showing a second example of the printing plate producing apparatus of this invention.

FIG. 2 is a front view schematically showing the second example of the color-separated printing plate production apparatus of this invention.

In the apparatus shown in FIG. 2, a numeral 31 is a large box-form main body, a numeral 32 is a small box-form developing case equipped to the left side of the main body 31, the main body 31 and the developing case 32 can be shielded from external light, a guide rail 33 is disposed in the main body at an upper portion in the right-to-left direction, a pair of sliders 34 are provided at the lower portion of the guide rail 33 independently movably in the right and left direction by a driving mechanism (not shown), and an original placing plate 35 and a lense system 36 are supported in hung state by the lower portions of the right side slider 34 and the left side slider 34, respectively, through each supporting frame 37.

Also, the aforesaid original placing table 35 can receive an original 38 at a definite position at left side of facing the lens system 36 and plurality light sources 39 for transparent original are disposed in the original placing plate 35. Also, plural light sources 40 for reflection original are supported by a pair of stands 41 with an interval in the lengthwise direction of each stand (said stands being disposed with a distance in the direction perpendicular to the paper of the figure) between the plate 35 and the lens system 36.

Also, three or more color filters 42 each being selectively used for color separating the color original 38 are equipped to the supporting frame 37 of the lens system 36, each being interchangeably inserted in the optical axis between the lens system 36 and the original placing table 35.

In addition, a bellows 43 for light shielding is disposed around the lens system 36, the bellows 43 is fixed to the supporting frame 37 of the lens system 36 at the right side and to the light-shielding frame 44 of the main body 31 at the left side, and the light-shielding frame 44 can pass only the light passed through the lens system at light exposure.

A reflection mirror 47 is supported by hanging in a supporting frame 48 of the main body 1 and a light passed along a horizontal optical axis from the original on the original placing table 35 through the color filter 42 and the lens system 36 is reflected thereby downward along a perpendicular optical axis. A contact screen 49 is disposed below the reflection mirror 47 movably in the direction perpendicular to the sheet of the figure and an original printing plate settling portion 50 is disposed under the contact screen 49.

In addition, the contact screen 49 is for forming dot images for expressing the intermediate tone of original and in the case of making a color-separated printing plate, a different contact screen 49 is selectively used for each color for preventing the formation of Moire pattern.

At the original printing plate settling portion 50 described above is disposed a suction plate 51 in the horizontal direction, said suction plate 51 being moval upward and downward and at the right side of the suction plate 51 is disposed an original printing plate supplying means 53 for supplying sheet-form original printing plates 52 one by one to the suction plate 51. A charging device 54 such as a corona discharging device, etc., is disposed between the original printing plate supplying means 53 and the suction plate 54 and outside the original printing plate supplying means 53 and the charging device 54 is disposed a light-shielding case 55.

Also, at the left side of the aforesaid suction table 51 are successively disposed a toner developing means 56 and a fixing means 57 in the aforesaid developing portion case 32, a printing plate receiving member 58 is disposed at the left side of the developing portion case 32 extending to the left side of the fixing means 57, and a transporting means 59 for transporting a printing plate to the printing plate receiving member 57 is disposed from the aforesaid original printing plate supplying means 53 through the charging device 54, the suction plate 51, the toner developing means 56, and the fixing means.

In the apparatus of the example, the color original 38 is placed on the original placing table 35, the original printing plate 52 with the light-sensitive layer directing upward is supplied from the original printing plate supplying means 53 and transported onto the suction plate 51 in lowered state by the transporting means 59 through the charging device 54 while electrostatically charging the original printing plate during passage thereof. After setting the charged original printing plate 52 on the suction plate 51 at a definite position, the suction plate 51 is raised and the light-sensitive layer of the original printing plate 52 is closely brought into contact with the contact screen 49 disposed below the reflection mirror 47. In this state, the light source 39 for transparent original or the light source for reflection original is lighted, the transmitted light or reflected light of the light from the original 38 is directed to the original printing plate 52 on the suction plate 51 through the the color filter, the lens system 36, and the reflection mirror 47 to expose the original printing plate 52 with the color-separated light color, separated by the color filter 42. Then, the suction plate 51 is decended to separate the original printing plate 52 from the contact screen 49, then the original printing plate 52 having electrostatic latent images of the color separation images formed by the light exposure is sent to the toner developing means 56 by the transporting means 59, wherein toner is attached to the latent images of the original printing plate 52 to form toner images, and then the original printing plate 52 is sent to the fixing means 57 by the transporting means 59, wherein the toner images of the original printing plate 52 is fixed. Then, the original printing plate 52 thus processed is transported to the plate receiving member 58.

Also, the original printing plate 52 having fixed toner images is introduced in a light-sensitive layer removing means or a hydrophilic treatment applying means, not shown, wherein the light-sensitive layer of the non-image portions is removed or subjected to a hydrophilic treatment to complete a color-separated printing plate.

In addition, when at light-exposure, the positions of the original placing plate 35 and the lens system 36 are adjusted by moving each slider 34, the original can be exposed to light with magnification or reduction. Also, doors, not shown, are disposed at plural portions at the front of the main body 31 and by opening the doors, mounting and demounting of the original 38 onto or from the original placing table 35, the supplement of original printing plates 52 to the original printing plate supplying means 53, the exchange of original printing plates 52 having different size, and the exchange of the contact screen 49 can be performed.

Then, the original printing plate supplying means in the second example is explained in detail.

Figure 3:
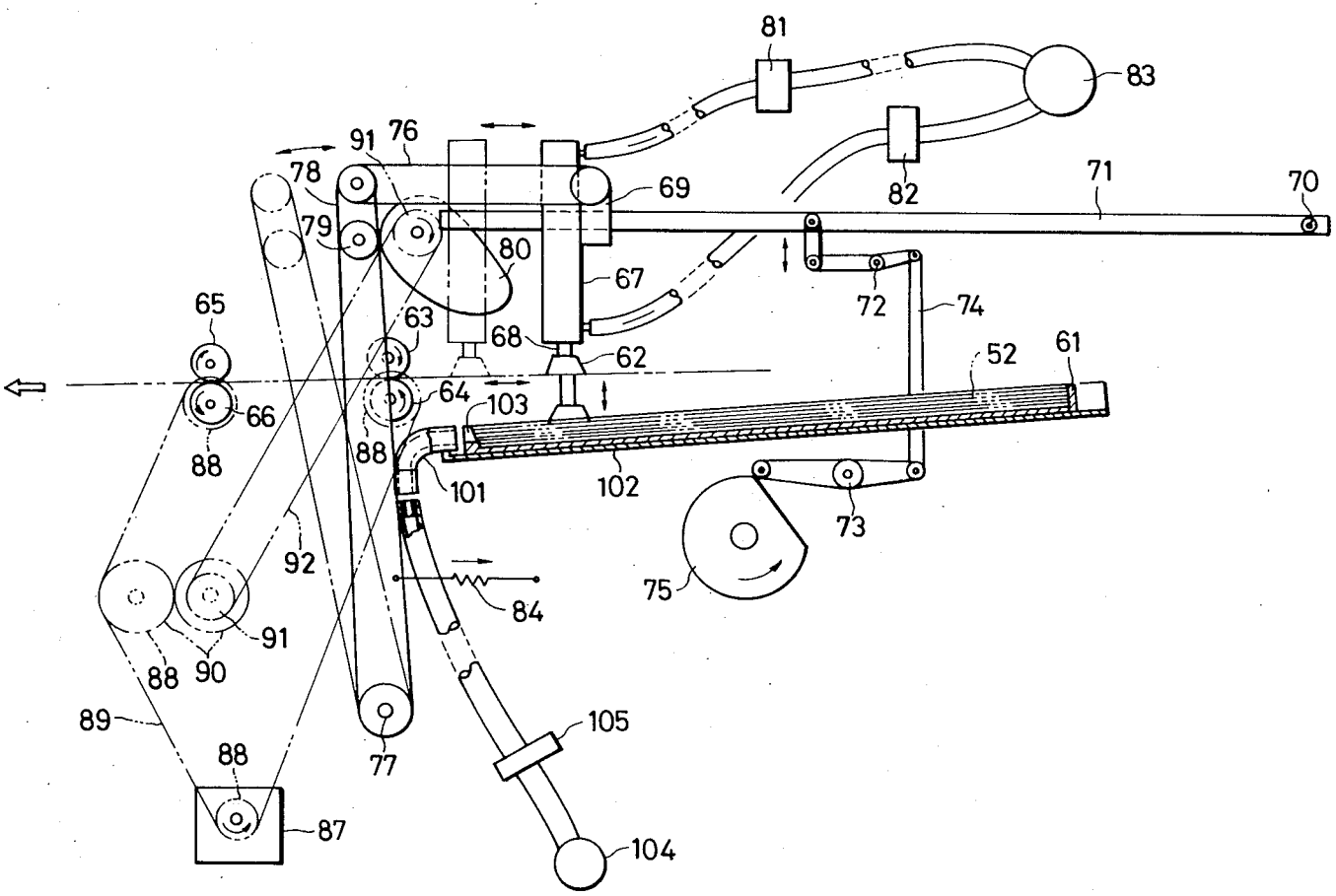
FIG. 3 is a schematic view of an original printing plate supplying means thereof, FIG. 4(*a*) to (*c*) is a view for explaining the movement of a suction rubber portion as a pulling device shown in FIG. 3.

As shown in FIG. 3, the original printing plate supplying means 53 has a cassete 61 having upper opening, plural sheet-form original printing plates 52 are placed in the cassette in laminated state with the light-sensitive layer directing upward, the uppermost original printing plate 52 in the cassete 61 is adsorbed to a suction rubber 62 as an adsorber, the left end of the adsorbed original printing plate 52 is inserted between upper and lower rubber rollers 63 and 64 constituting a part of the transporting means explained above in FIG. 2, and then the original printing plate 52 is transported onto the suction plate 51 by the rollers 63 and 64 and rollers 65 and 66 disposed at the left side of the rollers 63 and 64 through the charging device 54 as explained above in FIG. 2.

That is, the aforesaid suction rubber 62 is connected to a piston rod 68 of a cylinder mechanism 67, the cylinder mechanism 67 is connected to a slider 69, the slider 69 is movably supported on right and left by a lever 71, said lever 71 being vertically movably engaged in a shaft 70, one end of a link mechanism supported by a shafts 72 and 73 is pivotally connected to a middle portion of the lever 71, the other end of the link mechanism 74 is engaged with a cam 75 for ascending and descending the suction rubber 62, and by the turning motion of the cam 75, the suction rubber 62 is moved upward or downward. The slider 69 is pivotally connected to one end of a link 76, the other end of the link is pivotally connected to a lever 78 which is turnable to the right and left around a shaft 77 with the center, a roller 79 equipped to a middle portion of the lever 78 is engaged with a cam 80 for horizontal movement, and by the turning motion of the cam 80, the suction rubber 62 is horizontally moved on the right and left, Furthermore, the aforesaid cylinder mechanism 67 is connected to a pump 83 through an electromagnetic valves 81 and 82 and the suction rubber 62 performs the suction action through the electromagnetic valve 81 by the pump 83. Also, in the state of performing the suction action by the suction rubber 62, the suction rubber 62 descends by the turning motion of the cam 75, fast holds the uppermost original printing plate 52, the suction rubber 62 then ascends by the subsequent turning motion of the cam 75 to release the uppermost original printing plate 52 from the under original printing plates 52, thereafter, the suction rubber 62 is moved to the left side by the subsequent turning motion of the cam 80, the original printing plate 52 holded by the suction rubber 62 is inserted between the rollers 63 and 64, simultaneously therewith or directly before thereof,, the suction action of the suction rubber 62 is stopped by the electromagnetic valve 81, whereby the original printing plate 52 is released from the suction rubber 62 and transported onto the suction plate 51 through the charging device by the rollers 63, 64, 65 and 66 as shown in FIG. 2. Thereafter, the suction rubber 62 is moved to the right side by the turning motion of the cam 80 upto the original position. In addition, the lever 78 is energized to the left by a spring 84 to keep the connection of the roller 79 and the cam 80.

Also, a motor 87 drives the aforesaid rollers 64 and 66 through plural sprockets 88 and an endless chain 89, drives the aforesaid cam 80 through plural gears 90, an electromagnetic clutch, not shown, plural sprockets 91 and endless chain 92, and also drives the aforesaid cam 75 by a transmission mechanism including an electromagnetic clutch, not shown, whereby the ascending motion and horizontal movement of the original printing plate 52 by the suction rubber 62 and also the transportation of the original printing plate 52 by the rollers 63, 64, 65 and 66 are performed synchronously with each other.

In addition, in the aforesaid embodiment, plural suction rubbers 62 are employed for at least two portions of the left side of the original printing plate 52 or, in this case, for two corners of the left side of the original printing plate 52. Also, the positions and the materials of the suction rubber 62 and the rollers 63, 64, 65 and 66 are so selected that they do not injure the printing surface of the original printing plate 52.

Also, in the original printing plate supplying means 53, by using the aforesaid cylinder mechanism 67., when the suction rubber 62 holds the original printing plate 52, the suction rubber 62 does not press the other laminated original printing plates 52 and also when the original printing plate 52 is inserted between the rollers 63 and 64, the light-sensitive layer of the original printing plate 52 is protected by preventing the original printing plate 52 from being rubbed by the suction rubber 62 in the case of being inserted between the rollers 63 and 64.

Figure 4C:
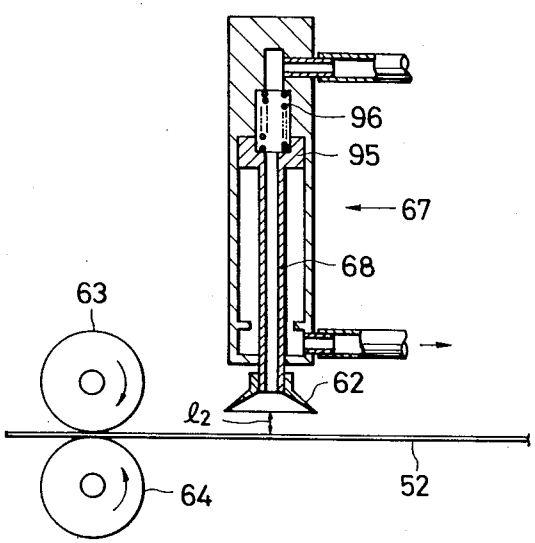
Figure 4B:
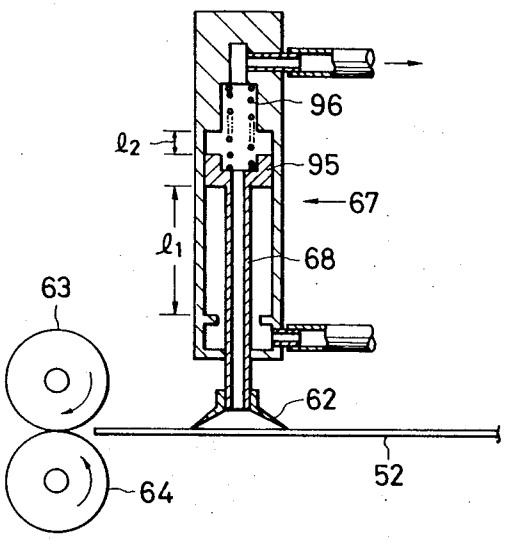
Figure 4A:
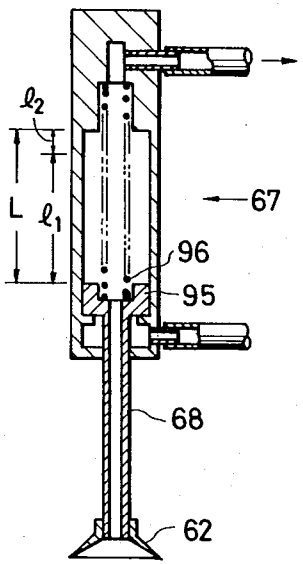

That is, as shown in FIG. 4, the piston rod 68 and a piston 95 of the cylinder mechanism 67 have each cavity therein, the upper portion of the aforesaid suction rubber 62 is engaged in the piston 95, and the piston 95 is energized downward by a spring 96 having a definite repulsive force against the differential pressure of the piston 95. Thus, when a sucking action is applied to the suction rubber 62 from the upper portion of the piston 95 through the electromagnetic valve 81 by the action of the pump 83 shown in FIG. 3, air enters the suction rubber 62 and hence when the suction rubber 62 in a lowered state by the action of the spring 96 as shown in FIG. 4(A) descends in the cassette 61 by the turning motion of the cam 75 shown in FIG. 3 and then is brought into contact with the uppermost original printing plate 52, the suction rubber 62 holds the original printing plate 52 and at the same time the entrance of air through the suction rubber 62 is stopped. Thus, when the suction rubber 62 is brought into contact with the original printing plate 52 and holds it, the piston 95 is immediately sucked upward against the action of the spring 96, whereby there is no trouble of pressing the original printing plates 52 in laminated state by the suction rubbers 62 in the case of holding the original printing plate 52 by the suction rubbers 62. Furthermore, in this case the piston 95 descends along the length $l_1$ in the whole length L of the piston stroke to the position of balancing the repulsive force of the spring 96 and the sucking force to the upper portion of the piston 95 and after further descending of the suction rubber 62 by the turning motion of the cam 75 shown in FIG. 3, the suction rubber 62 is moved to the left side by the turning motion of the cam shown in FIG. 3, the left side portion of the original printing plate 52 holded by the suction rubber 62 is inserted between the rollers 63 and 64, and at the same time or immediately before thereof, the sucking action of the suction rubber 62 is stopped. In this case, however, the sucking action from the upper portion of the piston 95 is stopped by the electromagnetic valve 81 to release the pressure in the upper portion thereof to atmospheric pressure and air is blown into the lower portion of the piston 95 through the electromagnetic valve 82 by the pump 83, whereby the suction rubber 62 releases the original printing plate 52 as shown in FIG. 4(C) and the piston 95 is raised along the remaining stroke $l_2$ against the spring 96. Accordingly, a gap $l_2$ of the stroke is formed between the original printing plate 52 and the suction rubber 62 and hence there is no anxiety of causing rubbing of the original printing plate 52 by the suction rubber 62 at the case of inserting the original printing plate 52 into the rollers 63 and 64.

In addition, the ascending stroke $l_1$ of the piston 95 by the sucking action is larger than the maximum value of the height of the laminated layers of the original printing plate 52 in the cassette 61.

Figure 5:
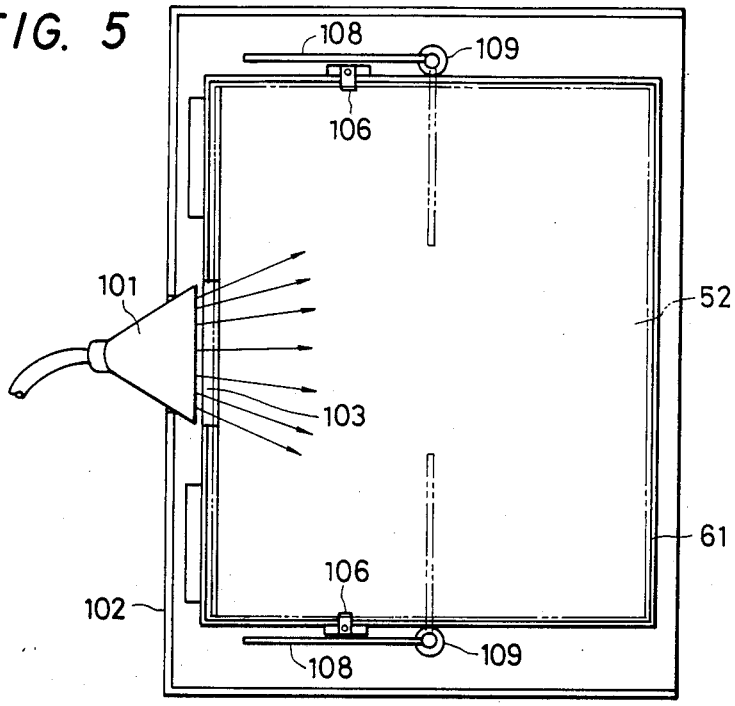
FIG. 5 is a front view of a casset portion shown in FIG. 3.
Figure 6:
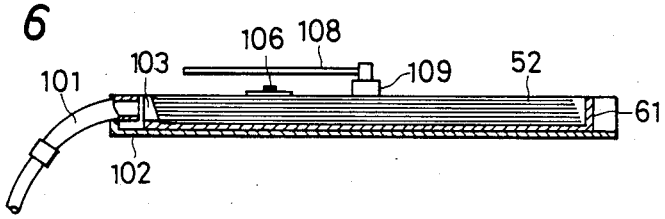
FIG. 6 is a cross sectional view of the casset portion shown in FIG. 5.
Figure 7:
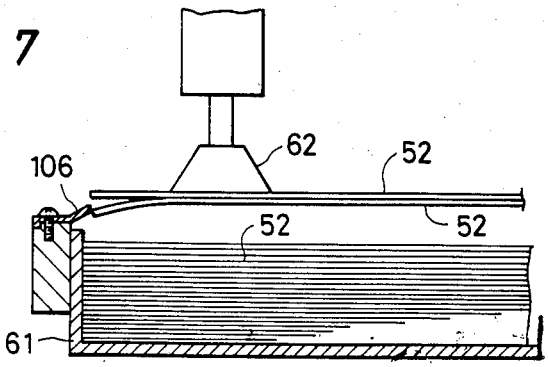
FIG. 7 is different partial cross sectional view from that of FIG. 6, FIG. 8(*a*) to (*c*) are views for explaining the movement is a supporting bar as an insertion member.

Also, in the original printing plate supplying means 53 for supplying the original printing plates 52 one by one, an air nozzle 101 is disposed at the left side portion of a stand 102 for placing the cassette 61 and a cut portion 103 is formed at the middle portion of the left side of the cassette 61 as shown in FIGS. 5 and 6. In the case of raising the uppermost original printing plate 52 by the suction rubber 62, air is supplied into the air nozzle 101 from a blower 104 through an electromagnetic valve 105 as shown in FIG. 3 and air is blown to the left side portion of the original printing plates 52 in laminated state from the air nozzle 101, whereby the under original printing plates 52 are prevented from being raised together with the uppermost printing plate 52. Also, for the same purpose, claws 106 composed of a thin plate spring are disposed at both side portions near the left side of the cassette 61 and thus at raising of the uppermost original printing plate 52 by the suction rubber 62, the under original printing plates 52 are prevented from raised together with the uppermost printing plate 52 by hooking the under original printing plates 52 by the claws 106.

In addition, the air nozzle 101 not only prevents the raising of the under original printing plates 52 together with the uppermost printing plate 52 but also functions to blow away dusts on the original printing plate 52.

Also, the claws 106 may be disposed not only at the positions shown in the figure but also at the left side portions of the cassette 61, i.e., both sides of the air nozzle 101.

Furthermore, in the original printing plate supplying means 53/ when after raising the uppermost original printing plate 52 by the suction rubber 62, the original printing plate 52 is moved to the left by the suction rubber 62 and the rollers 63, 64, 65 and 66, the original printing plate 52 is completely separated from the under original printing plates 52 using a supporting bar 108 as an insertion for not rubbing the original printing plate 52 in the cassette 61 by the raised original printing plate 52.

Figure 8A:
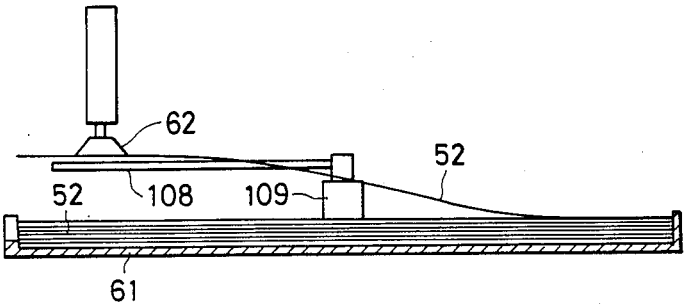
Figure 8B:
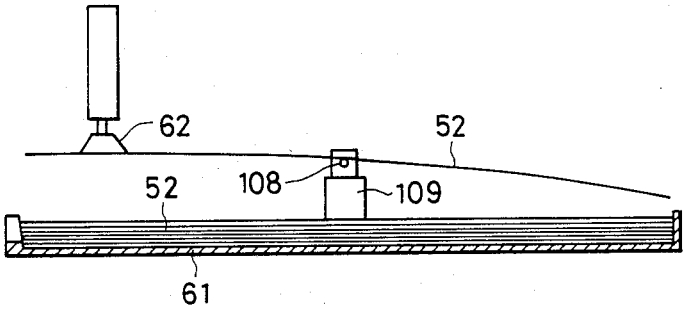
Figure 8C:
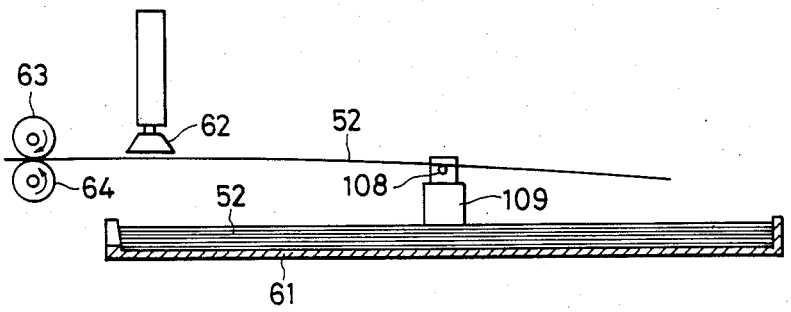

That is, as shown in FIGS. 5 and 6, rotary solenoids 109 are disposed at both sides of the middle portion of a stand 102 for placing the cessette 61, each supporting bar 108 is equipped to the rotary portion of each rotary solenoid 109, and the supporting bar 108 can turn between the state shown by solid line directing to the aforesaid suction rubber 62 side along the edge of the cassette 61 and the state shown by chain line extending onto the cassette 61 at 90 degree in the horizontal direction (i.e., in the plane parallel to the original printing plate 52 in the cassette 61). When in the state of the solid line of both the supporting bars 108 directing to the left, after raising the left side of the original printing plate 52 by the suction rubber 62, both the supporting bars both the supporting bars are turned 90 degree to the side of cassete 61 as shown in FIG. 8(A), the supporting bars 108 enter the lower portion of the original printing plate 52 from the left side thereof raised by the suction rubber 62 and is moved to the right side thereof to raise the original printing plate 52 from the middle portion to the right side as shown in FIG. 8(B). Thus, the original printing plate 52 raised by the suction rubber 62 can be completely separated from the under original printing plates 52 and hence when the original printing plate 52 is moved to the left side by the suction rubber 62 and the rollers 63, 64, 65 and 66, the right side portion of the moving original printing plate 52 is supported by the supporting bars 108 as shown in FIG. 8(C) and hence there are neither trouble of rubbing the original printing plate 52 in the cassette 61 by the suction rubber 62 nor trouble of injuring the light-sensitive layer of the under original printing plate 52.

In addition, the lower surface of the original printing plate 52 is rubbed by the supporting bars 108 but since the lower surface of the original printing plate 52 has no light-sensitive layer, no trouble occurs by such rubbing.

Then, the relation, between the suction plate 51 and the contact screen 49 in this example is explained in detail.

Figure 9:
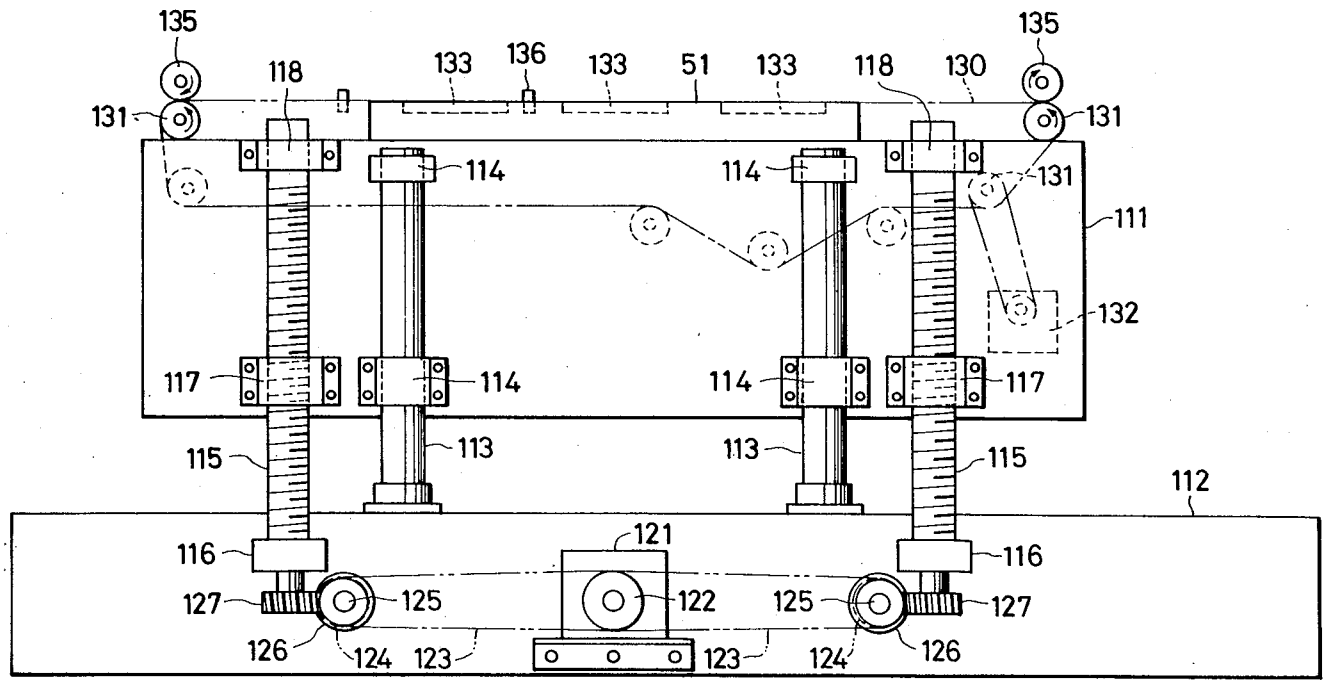
FIG. 9 is a front view of a suction plate portion.
Figure 10:
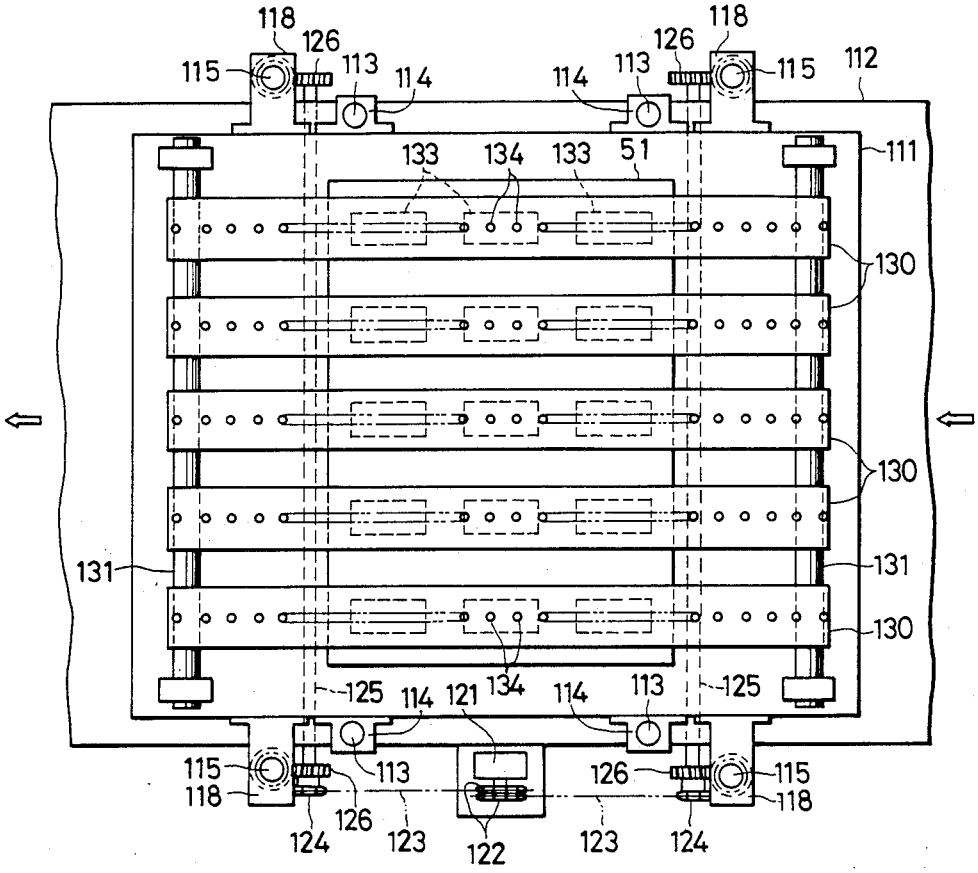
FIG. 10 is a plane view of the suction plate portion shown in FIG. 9.
Figure 11:
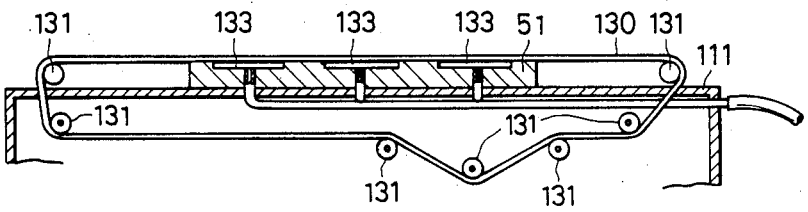
FIG. 11 is a cross sectional view of the suction plate portion.

The suction plate 51 placed on a box-form elevating frame 111 and the elevating frame 111 is vertically movably disposed on a fix stand 112 as shown in FIG. 9 to FIG. 11.

That is, four supports 113 are vertically set up on both sides of the fix stand 112, four sets of a pair of upper and lower slide bearings 114 are equipped to both side portions of the elevating frame 111, and each support 113 is slidably inserted in each pair of the upper and lower slide bearings 114, whereby the elevating frame 111 is vertically movably supported on the fix sand 112. Also, four screw shafts 115 are vertically set up from both the side portions of the fix stand 112 via thrust bearings 116, four set of nuts 117 and four sets of slide bearings 118 are fixed to both side portions of the elevating frame 111, and each screw shaft 115 is screwed in each nut 117 and also slidably inserted in each slide bearing 118. Thus, by synchronously rotating he four screw shafts 115, the elevating frame 111 is vertically moved by the screwing action of each screw shaft 115 and the nut 117, and the suction table 51 is vertically moved together with the elevating frame 111.

Also, the four screw shafts 115 are rotated by a motor 121 mounted on one side of the fix stand 112 and a pair of drive shafts 125 equipped to the fix stand 112 are rotated via a chain 123 and sprockets 124 by a pair of sprockets 122 engaged with the output shaft of the motor 121. The rotation is transmitted both end portions of each of a pair of the drive shafts 124 via each of a pair of screw gears 126 and 127 to the lower portion of each of the aforesaid screw shafts 115, whereby the four screw shafts 115 are synchronized to rotate to a definite direction at a definite speed.

Also, the aforesaid suction plate 51 does not directly hold the original printing plate 52 but holds it with plurality endless belts 130 constituting a pair of the transporting means 59 between them as explained above in FIG. 2.

That is, the aforesaid plural belts 130 are mounted on the aforesaid elevating frame 111 by plural rollers 131 and by driving one of the rollers 131 by the motor 132, the upper moving portions of the plural belts 130 move along the transporting direction of the original printing plate 52 through the charging device 54 towards the toner developing means 56. Also, many suction grooves 133 are formed on the upper surface of the aforesaid suction plate 51 at portions covered by each belt 130 and each belt 130 has many suction holes 134 which will be engaged in each suction groove 133. By evacuating the suction grooves 133 by a vacuum pump not shown, the original printing plate 52 can be sucked by the suction holes 134 of the belts 130, which have been brought into connection with the suction grooves 133. Thus, the original printing plate 52 sent through the charging device 54 can be transported onto the suction plate 51 supported by the plural belts 130, then the original printing plate 52 can be stuck to the suction plate 51 via the belts 130, and further, the original printing plate 52 can be sent from the suction plate 51 to the toner developing means 56 as shown in FIG. 2.

In addition, in FIG. 9, a numeral 135 is rollers which will integral with the elevating frame 111 and hold the original printing plate 52 between the roller 135 and the belt 130, and the materials, etc., of the rollers 135 are so designed that the printing surface of the original printing plate 52 is not injured and the electrostatially charged state thereof is not changed. Also, a numeral 136 is a detection stopper for defining the position of the original printing plate 52 on the suction plate 51 and the detection stopper 136 can change the position thereof in the travelling direction of the original printing plate 52 according to the size of the original printing plate 52 for disposing the original printing plate 52 at the central portion of the suction plate 51.

Figure 12:
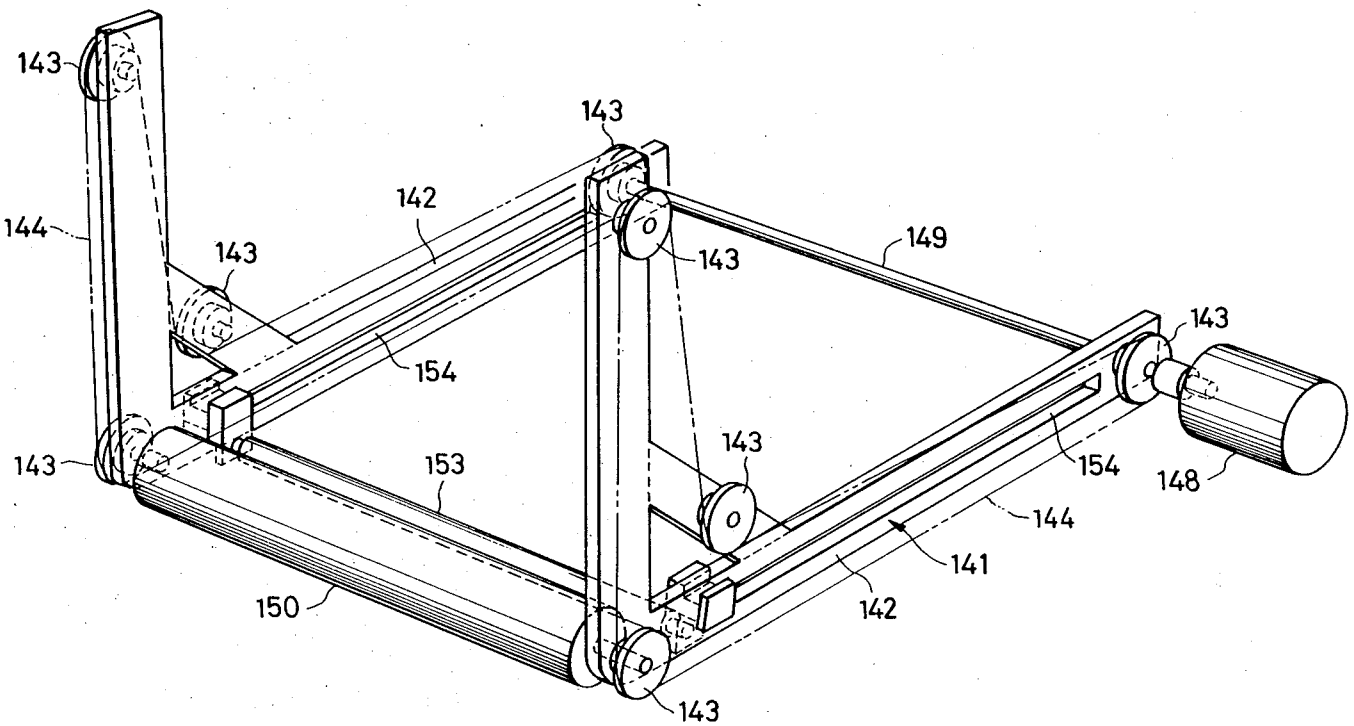
FIG. 12 is a slant view of a guide frame for screen.
Figure 13:
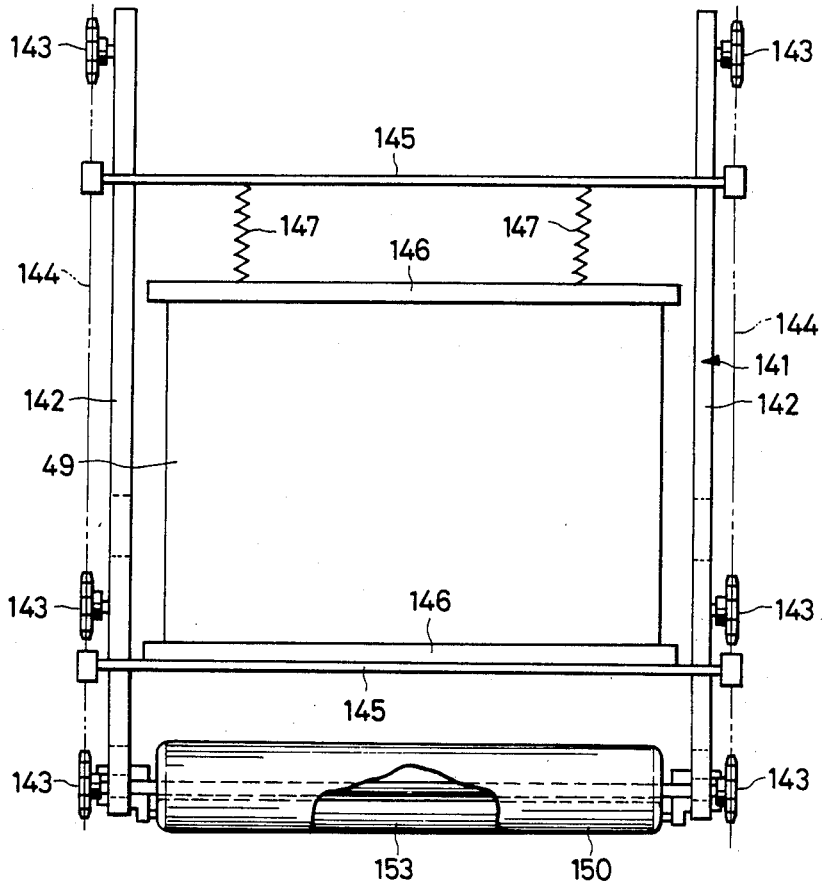
FIG. 13 is a front view of the guide frame, and FIG. 14(*a*) to (*f*) is views for explaining the movements of the suction plate and the screen.

The contact screen 49 is movably supported by a guide frame 141 as shown in FIG. 12 and FIG. 13, whereby the contact screen 49 can be advanced from the front (the upper side of the sheet of FIG. 2) to the lower portion of the reflection mirror 47 as shown in FIG. 2.

That is, as shown in FIG. 12 and FIG. 13, the guide frame 141 is composed of a pair of L-shaped side frames 142 which are disposed in parallel to each other with a definite interval, the vertical portion of each side frame 142 is disposed at the right or left side of the front (the upper portion of the sheet of FIG. 2) of the reflection mirror 47 shown in FIG. 2 and the horizontal portion of each side frame 142 is disposed at the right or left of the lower portion of the reflection mirror 47 as shown in FIG. 2. Plural sprockets 143 are equipped to the outer side of each side frame 142 and an endless chain 144 is mounted in L-form on the plural sprockets 143 of each side frame 142. A pair of fitting bars 145 are engaged with both chains 144 in parallel to each other with a definite interval, a screen frame 146 supporting one side of the aforesaid contact screen 49 is directly and releasably fitted to one of the fitting bars 145, and a sereen frame 146 supporting the other side of the contact screen 49 is releasably equipped to the other setting bar 145 via plurality springs 147. Thus, by rotating the sprockets 143 at the ends of the horizontal portions of the side frames 142 via one drive shaft 149 by a motor 148, the chains 144 at both sides are synchronously turned round, whereby after lowering the contact screen 49 from the front (the upper side of the sheet of FIG. 2) of the reflection mirror 47, the contact screen 49 is horizontally advanced to the lower portion of the reflection mirror 49, and on the other hand, after transporting from the lower portion of the reflection mirror 47 to the front thereof, the contact screen 49 is vertically retreated to the front of the reflection mirror 47.

In addition, the contact screen 49 can be exchanged by releasing the screen frame 146 from the setting bars 145.

Also, a numeral 150 is a roller rotably supported by both side frames 141 for guiding the travelling contact screen 49 and when the contact screen 49 passes through the roller 150 portion, the interval between a pair of the setting bars 145 equipped to the chains 144 is changed but the change of the interval is absorbed by the springs 147, which prevents the occurence of loosening of the contact screen 49 and the application of excessive tension to the contact screen 49.

Also, a numeral 153 is a squeeze roller for closely bringing the contact screen 49 contact with the original printing plate 52 on the suction plate 51, the squeeze roller 153 is movably disposed between the horizontal portions of both the side frames 141 and moves along the guide grooves 154 each formed in the horizontal portion of each side frame by a driving mechanism, not shown.

Then, the related behavior of the suction plate 51 and the contact screen is explained based on FIG. 14.

Figure 14A:
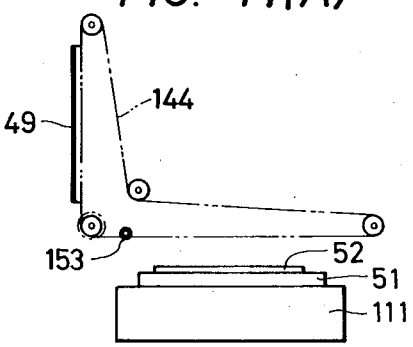
Figure 14B:
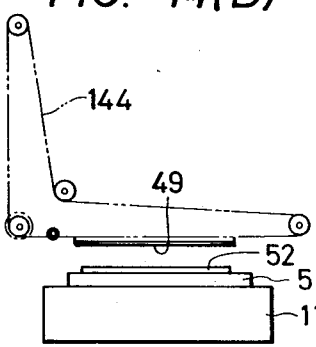
Figure 14C:
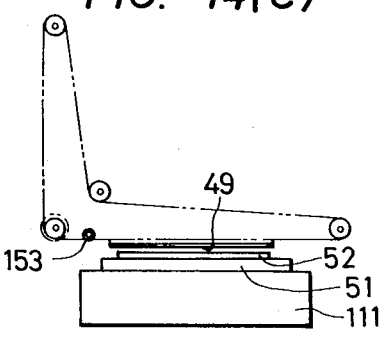
Figure 14D:
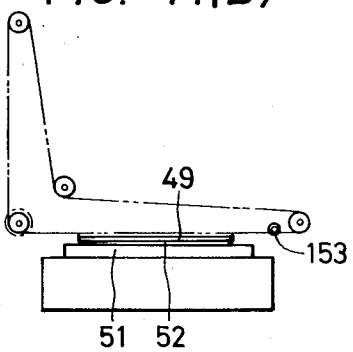
Figure 14E:
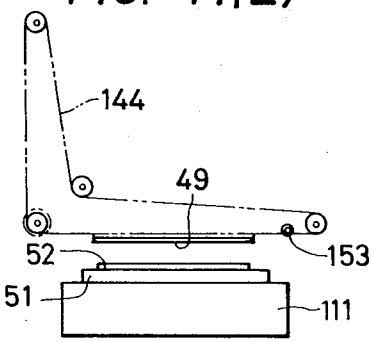
Figure 14F:
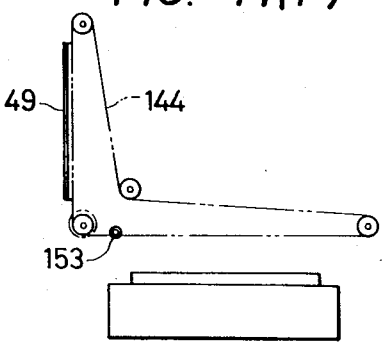

In the case of light-exposing the original printing plate 52, as shown in FIG. 14(A), after placing by suction the original printing plate 52 transported through the charging device 54 shown in FIG. 2 at the definite position of the suction table 51 in a lowered state, the contact screen 49 is advanced to the lower portion by the chain 144 as shown in FIG. 14(B) and the contact screen 49 is faced in parallel to the original printing plate 52 on the suction plate 51. Then, as shown in FIG. (C), the suction plate 51 is raised by the elevating frame 111 to bringing the original printing plate 52 on the suction plate 51 contact with the contact screen 49. Also, as shown in FIG. 14(D), the squeeze roller 153 is moved along the upper surface of the contact screen 49 to closely bring the contact screen contact with the original printing plate 52 on the suction plate 51. After performing light exposure, as shown in FIG. 14(E), the suction plate 51 is vertically lowered by the elevating frame 111 to vertically release the original printing plate 52 on the suction plate 51 from the contact screen 49. Then, as shown in FIG. 14(F), after the contact screen 49 is retreated to upper portion by the chain 144 and the squeeze roller 153 is moved back to starting position, the original printing plate 52 thus exposed is sent to the toner developing device 56 shown in FIG. 2.

Since in this case, the light-sensitive layer of the original printing plate 52 has been electrotatically charged, there is a possibility of causing a sparking phenomenon between the original printing plate 52 and the contact screen 49, on separating he original printing plate 52 from the contact screen 49. However, in this case, since the suction plate 51 holding the original printing plate 52 vertically moves, the interval between the original printing plate 52 and the contact screen 49 is kept equal at any positions and also the contact screen 49 is instantly separated from the original printing plate 52, whereby the concentration of electrostatic charged to specific portions does not occur and hence a sparking phenomenon does not occur to prevent the latent images formed by light-exposure from being disturbed.

In addition, in regard to the original printing plate 52 and the contact screen 49, the suction plate 51 holding the original printing plate 52 is designed to be vertically movable in the aforesaid example but the guide frame 141 supporting the contact screen 49 may be designed to be vertical movable.

While the invention has been described in detail and with reference to specific embodiments thereof, it will be apparent to one skilled in the art that various changes and modifications can be made therein without departing from the spirit and scope thereof.

We claim:

1. A method of producing a printing plate, comprising the steps of:

forming toner images on an original printing plate by an electrophotographic process by using a photoconductive material as the original printing plate;

fixing said toner images formed on said original printing plate;

removing non-image portions of a photoconductive layer or rendering non-image portions hydrophilic directly from said original printing plate to produce a color-separated printing plate;

using an organic photoconductive material having light-sensitive characteristics at a whole light wavelength region of between 400 n.m. and 700 n.m. for said photoconductive material;

directly exposing said original printing plate to color-separated light obtained by color separating at least one of a transmitted light and a reflected light from a color original to thereby directly obtain a color-separated printing plate from said color original.

2. An apparatus for producing a printing plate by using an organic photoconductive material having light-sensitivity at a whole light wavelength region of between 400 n.m. and 700 n.m. and for producing a color-separated printing plate by an electrophotographic process, comprising:

a plate means for placing an original;

a light source means for illuminating said original;

color filter means for color-separating light from said original;

a lens means for directly exposing said color-separated light onto said original printing plate;

an original printing plate setting means for receiving said original printing plate;

a means for electrostatically charging said original printing plate;

a means for developing said original printing plate which has been exposed;

a means for fixing toner images formed by said developing means;

at least one of a means for receiving said developed original printing plate and for removing non-image portions of said photoconductive material and a means for said original printing plate; and a means for transporting at least one of said original printing plate and said printing plate thus produced from at least one of said non-image portion removing means and hydrophilic rendering means.

3. The apparatus for producing a printing plate as claimed in claim 2, further comprising an original printing plate supplying means for separating and supplying sheet-form original printing plates in stacked state one by one and the original printing plate supplying means is provided with vertically movable suction members holding one side of the upper surface of the uppermost original printing plate in laminated state and raising with it and a horizontally movable insertion entering the lower portion of the original printing plate raised by the suction members from one side of the original printing plate and moving to the other side of the original printing plate.

4. The apparatus for producing a printing plate as claimed in claim 2 or 3, further comprising a suction plate holding by suction the original printing plate at light-exposure of the original printing plate and a screen which will be closely brought into contact with the original printing plate on the suction plate, said suction plate and said screen being so designed that they can relatively approach or part from each other in the vertical direction thereof.

* * * * *